United States Patent [19]

Ruggles

[11] Patent Number: 4,936,048

[45] Date of Patent: Jun. 26, 1990

[54] SWIVEL SHUTTER ASSEMBLY

[76] Inventor: Kay Ruggles, 2928 Oakridge Dr., Salt Lake City, Utah 84109

[21] Appl. No.: 364,127

[22] Filed: Jun. 12, 1989

[51] Int. Cl.[5] ..... E05F 17/00; E06B 7/08

[52] U.S. Cl. ..... 49/74; 49/89; 49/90; 160/236

[58] Field of Search ..... 49/74, 89, 90, 311; 160/236; 98/121.2

[56] References Cited

U.S. PATENT DOCUMENTS

| | | | |
|---|---|---|---|
| 207,026 | 8/1878 | Fuller | 49/90 X |
| 279,379 | 6/1883 | Hall | 49/74 |
| 2,091,012 | 8/1937 | Pratt | 160/236 UX |
| 2,395,319 | 2/1946 | Davies | 49/89 |
| 3,324,785 | 6/1967 | Underdahl | 49/74 X |
| 3,691,687 | 9/1972 | Economou | 49/74 |
| 4,276,954 | 7/1981 | Romano | 160/236 X |
| 4,513,655 | 4/1985 | Dayus | 98/121.2 |
| 4,519,435 | 5/1985 | Stier | 160/236 X |
| 4,655,003 | 4/1987 | Henley, Sr. | 49/74 X |
| 4,709,506 | 12/1987 | Lukaszonas | 49/90 X |

*Primary Examiner*—Philip C. Kannan
*Attorney, Agent, or Firm*—M. Reid Russell

[57] ABSTRACT

The present invention is in a swivel shutter that incorporates louvers that are pivotally mounted in a rectangular frame that is formed by joining, at their ends, top and bottom rails with left and right stiles. The louver pivotal mounting includes fixed and retracting conical shaped pivots that are individually fitted as aligned pairs or are arranged as bars of joined pivot sections into appropriate holes or slots in the left and right stiles. The individual pivots are for fitting into conical shaped holes that are formed in louver ends, the pivot of each retracting pivot to retract against a spring biasing into and below the level of the stile side, allowing a louver end hole to be aligned therewith. The invention further includes a tilt rod for mounting across aligned louver ends to simultaneously pivot the louvers between open and closed attitudes and a system for applying, to each louver faces, a section or sections of a flexible material as a veneer.

21 Claims, 3 Drawing Sheets

SWIVEL SHUTTER ASSEMBLY

BACKGROUND OF THE INVENTION

1. Field of the Invention

This invention relates to blind and shutter assemblies and particularly to louver swivel mounts therefor.

2. Prior Art

It has long been known and in common practice in the manufacture of louvered wood shutters to pivotally mount the louvers and such shutters between left and right stiles that are spaced apart between top and bottom rails, through use of wood dowels. The dowels extend from the louver ends and fit loosely into holes formed at equal intervals in the stiles. In such manufacture, one stile incorporates louvers that are pivotally fitted and maintained to one stile, as in a holding jig, while an opposite stile is fitted thereto and the top and bottom rails are secured to the stile ends to form the shutter. Obviously, this procedure is time consuming and labor intensive.

A number of arrangements have heretofore been implemented to speed up and simplify such shutter louver fitting process. In a patent to Economou, U.S. Pat. No. 3,691,687, each louver is fitted to the ends of a pivoting arm that is mounted to an adapter block which is arranged to fit in a longitudinal groove formed in each of the shutter left and right stiles. The adapter blocks stack, and the top and bottom rails close over the groove ends. A patent to Henley, U.S. Pat. No. 4,655,003, shows shutter rails that are grooved laterally, above pivot holes, to accommodate a dowel traveling therealong. Which dowel extends from the louver end, and is to drop into a pivot hole located below that groove. Also, a patent to Lukaszonas, U.S. Pat. No. 4,709,506, shows a use of "L" shaped clips that each have an outwardly extending pin. Each pin is for fitting into an appropriate hole that is formed in the shutter side, with the right angle clip leg for mounting to a louver end.

Where, of course, the above cited patents illustrate a recognition of the need for a simple and inexpensive way to pivotally mount individual louvers in a shutter frame, none anticipate either the combination of fixed and retracting pivots; their assembly and mounting in the shutter stiles; nor the tapered pivot and tapered louver pivot hole configuration of the present invention.

SUMMARY OF THE INVENTION

Objects of the Invention

It is a principal object of the present invention in a swivel shutter assembly to provide a louver pivot mounting system whereby individual louvers of such shutter can be installed within an assembled shutter frame.

Another object of the present invention is to provide a length and spacing adjustable universal louver pivot mounting system for accommodating a range of louver widths.

Another object of the present invention is to provide pivots for a louver pivot mounting system and louver holes for receiving the pivots in a self centering arrangement.

Another object of the present invention is to provide retractable pivots arranged for manual retraction for conveniently mounting and dismounting individual louvers in a shutter frame.

Still another object of the present invention is to provide a tilt rod assembly for a pivoting louver shutter assembly that will closely fit or nest to the shutter frame stiles.

Still another object of the present invention is to provide a system for wrapping the individual louvers with a section of a flexible material such as a decorative cloth.

Still another object of the present invention is to provide a swivel shutter assembly that is easily assembled in a matter of minutes into a finished shutter with moveable louvers.

The present invention is in a swivel shutter assembly where an end user can purchase, as component parts, a certain size of pivoting louver shutter and can easily and quickly assemble those parts into a finished shutter that is ready to hang. Shutter size is, of course, determined by the lengths of, respectively, the left and right stiles and top and bottom rails. To assemble the frame, the stiles and top and bottom rails are dovetailed for gluing together to form the shutter frame. To fit individual louvers in the prepared frame, the present invention provides fixed and retracting pivots that are manufactured as individual pivot sections that in one embodiment are snapped together, end to end, at male and female couplings, into a train or bar, and in another embodiment are individually fitted into holes appropriately prepared in the stiles. The pivots in the train or bar are spaced equidistantly apart for a certain width, and may include spacers arranged between the pivot sections for a particular width of louver.

The individual retracting pivots are spring biased to extend beyond the stile, which spring biasing is overcome by an operator, as with a tool urging a retracting tab portion of the pivot into a cavity formed in the stile, the pivot moving therewith against the spring biasing to retract that pivot into the stile.

The bars of fixed and retracting pivots are for installation in slots or grooves that are formed in the opposing edges of the left and right stiles. When fitted in the stiles, the pivots of both the pivot bars and individual retracting and fixed pivots exactly align with one another, each to fit in a center hole formed in a louver end. The pivots and holes are preferably identically conical in shape to provide a centering and close fitting engagement of each pivot in its louver hole. Each louver is installed in the shutter frame by sliding one louver end hole into the fixed pivot, and manually retracting the retracting pivot to below the level of the stile edge to align the opposite louver end hole therewith. The retracting pivot is then released and its biasing flexes the pivot into that louver hole.

The present invention, to provide for simultaneous pivoting of the louvers within the frame, includes a tilt rod. The tilt rod is for connection, as with screws or nails, into the louver ends at points that are equally spaced apart from the aligned louver fixed pivot hole. The tilt rod is arranged to fit, in nesting engagement, against one stile.

BRIEF DESCRIPTION OF THE DRAWINGS

These and other objects and features of the present invention will become more apparent from the following description in which the invention is described in detail in conjunction with the accompanying drawings.

DETAILED DESCRIPTION

Figure 1:
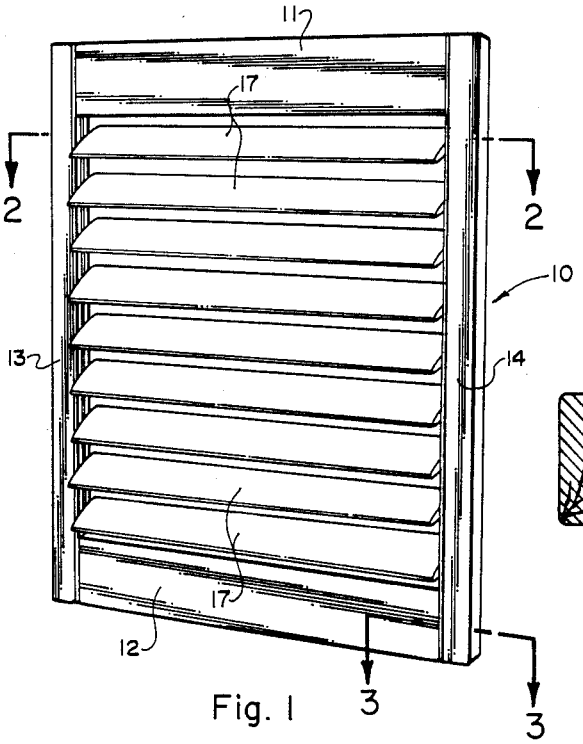
FIG. 1 shows a front elevation view of a first embodiment of a swivel shutter assembly of the present invention.

FIG. 1 shows a profile perspective view of a first embodiment of the present invention in a swivel shutter assembly 10, hereinafter referred to as shutter. Shutter 10 includes top and bottom rails 11 and 12, respectively, and left and right stiles 14, respectively, that are fitted to form a rectangular shutter frame. The respective top and bottom rails 11 and 12 may be identical or may be of different widths by design choice, and the left and right stiles 13 and 14 are preferably identical. Except that the one stile, shown as right stile 14, as shown best in FIGS. 2 and 4, is preferably grooved or stepped at an inner face thereof to accommodate a control rod 34 nesting thereagainst, as will be explained in detail hereinbelow.

Figure 3:
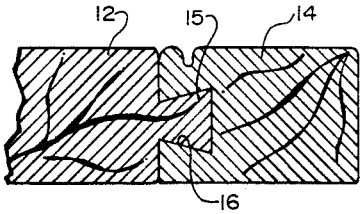
FIG. 3 shows a sectional view taken within the line 3—3 of FIG. 1.

Shown best in FIG. 3, for joining the respective top and bottom rails 11 and 12, they are each provided with an outer dovetail 15, as shown in FIG. 3, and the left and right stiles 13 and 14 have inner dovetails 16 formed therein. Accordingly, to form the shutter frame, as shown in FIG. 1, the inner dovetails 16 of stiles 13 and 14 are slid and glued onto outer dovetails 15 of the top and bottom rails 11 and 12.

Unique to the shutter 10 of the present invention the shutter frame is assembled prior to the fitting of louvers 17 within that frame. The louvers 17, as well as the frame, can be formed of wood, as illustrated in FIG. 2, or other material such as plastic, and which louvers can include a cover or veneer coating, as set out hereinbelow.

Figure 2:
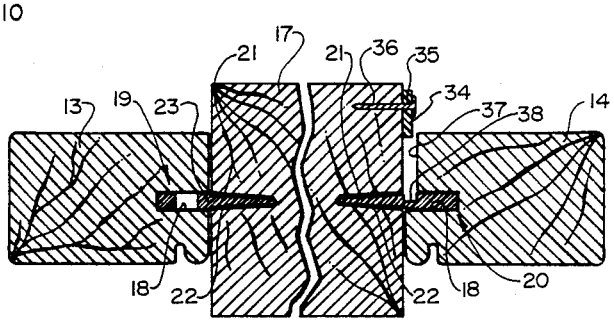
FIG. 2 shows a broken away sectional view taken along the line 2—2 of FIG. 1.
Figure 4:
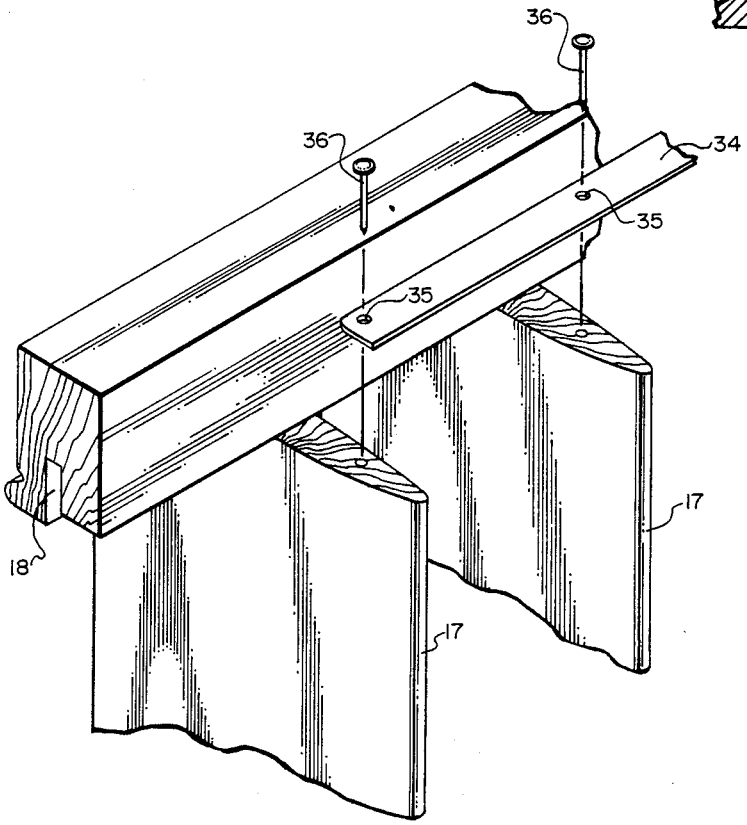
FIG. 4 shows an enlarged broken away section of a right stile with sections of the louvers of FIG. 2 fitted thereto, and shows a tilt rod for installing across the louver ends.
Figure 5:
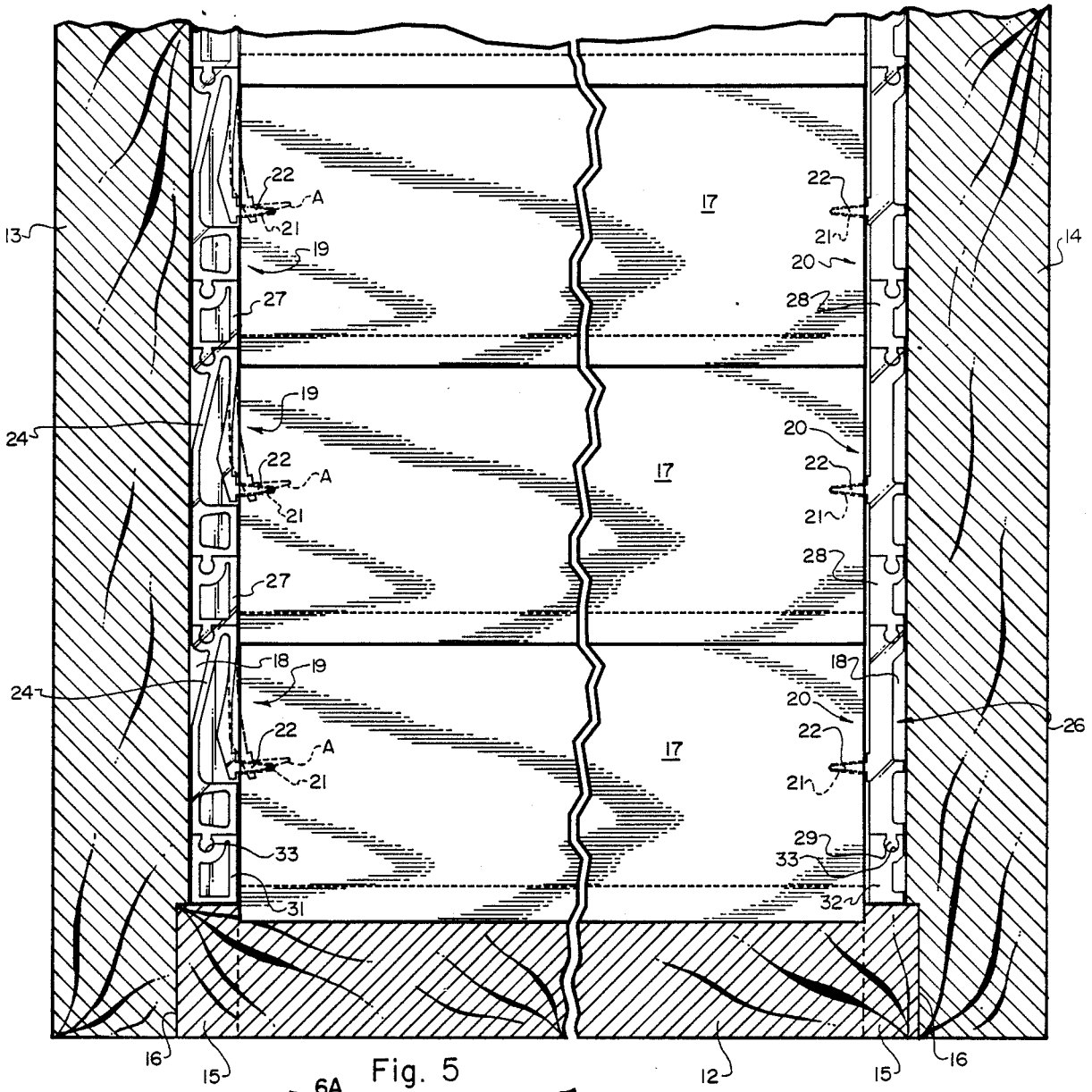
FIG. 5 shows a view of louver mounting fixed and retracting pivots and spacers that are connected end to end into bars with pivots thereof fitted into the louver ends, a center portion of which louvers is shown as having been removed.

To assemble the louvers 17 within the frame of shutter 10, the left and right stiles 13 and 14 opposing edges or faces are longitudinally slotted at 18, as shown in FIGS. 2, 4 and 5. The slots 18 are to receive, respectively, a retracting pivot bar 19 and a fixed pivot bar 20, that are shown best in FIGS. 5, 6 and 7. Shown best in FIGS. 2 and 5, the louvers 17 opposite ends are center holed at 21, which holes 21 are preferably inwardly tapered or cone shaped to accommodate like tapered or cone shaped pivots 22 of the respective retracting and fixed pivot bars, 19 and 20. So arranged, a pivot 22 traveling into a hole 21 will enter, self center and seat snugly therein, providing an engagement of that pivot over its entire length within the hole 21 wall.

In assembling each louver 17 into the shutter frame one louver end hole 21 is first fitted into a pivot 22 of the fixed pivot bar 20. The pivot 22 of the retracting pivot bar 19 extends outwardly at approximately a right angle from one end of a resilient leaf 23. Leaf 23, when depressed from the attitude shown at broken line A in FIG. 5, and the solid line configuration of FIG. 6, retracts into the longitudinal slot 18 of the left stile 13, as shown in the broken line configuration B in FIG. 6. The louver end can then be slid over the retracted pivot until the louver end hole 21 aligns with the end of the pivot 22. Thereafter, the leaf 23 is released and springs or flexes outwardly to the attitude shown as the broken line configuration C in FIG. 6. In this configuration, pivot 22 will have entered and fit snugly within louver end hole 21, as illustrated in FIGS. 2 and 5. Removal of the louver 17 is the reverse of the procedure set out above. Where an operator, not shown, depresses leaf 23 to the attitude shown at broken line B in FIG. 6. Whereat the pivot 22 will have been moved out of louver hole 21, allowing the louver to be rotated out of the shutter frame.

Figure 6A:
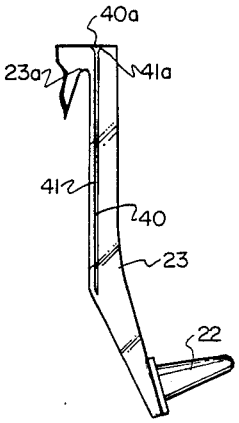
FIG. 6A shows a sectional view taken within the line 6A—6A of FIG. 6.

To provide for required flexure of leaf 23, that leaf, the pivot 22 and a body 24 whereto the leaf is attached are preferably manufactured as a single unit from a nylon or a like resilient plastic material. Shown best in FIG. 6, the leaf 23, at its end, preferably includes a resilient hinge junction 23a with body 24, that hinge junction to exhibit a spring biasing so as to flex the leaf outwardly to the attitude shown as the broken line configuration A of FIG. 5, and the solid line configuration in FIG. 6. That spring biasing urges the pivot 22 into a snug fitting engagement within a louver end hole 21. Where nylon plastic is preferred for the manufacture of both the retractable and fixed pivot bars, 19 and 20, it should be obvious that another material can be substituted therefore within the scope of this disclosure. Additionally, to provide an increased and reliable resiliency to leaf 23, as shown best in FIG. 6A, a thin, narrow strip 40 of a resilient material, such as spring steel can be installed in a longitudinal hole 41 through the hinge junction 23a and extending along the back side of the leaf. Where the leaf 23 is subjected to changes in temperature over time as could alter the resilient characteristics of a plastic material, such thin, narrow strip 40 will compensate for such loss or resiliency. Which thin, narrow strip 40 is headed at 40A to fit in a recess 41*a* that is counter sunk into the top of the longitudinal hole 41.

Figure 6:
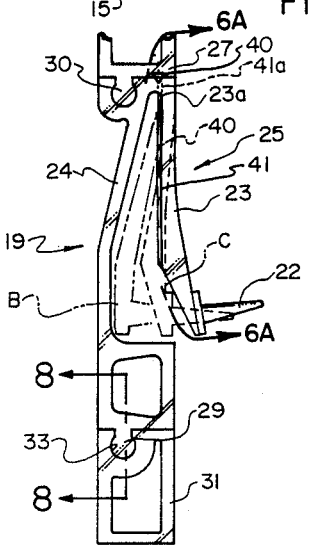
FIG. 6 shows a side elevation view of the retracting pivot, spacer and end spacer of FIG. 5, showing, in broken lines, a pivot and leaf thereof that are flexed inwardly.
Figure 7:
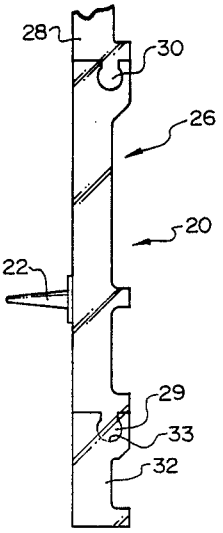
FIG. 7 shows a side elevation view of the fixed pivot, spacer, and end spacer of FIG. 5.
Figure 8:
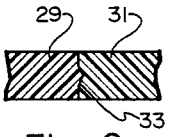
FIG. 8 shows a top plan sectional view taken along the line 8—8 of FIG. 6.

Shown best in FIGS. 5 through 7, retracting and fixed pivot bars 19 and 20 are assembled from individual pivot sections 25 and 26, that may include retracting and fixed spacers 27 and 28, respectively, arranged between each pivot section. The spacers are for serial connection between the individual pivot sections. For providing this end to end coupling, a round male end 29 of a pivot section 26 of spacer 27 or 28 is for fitting into a female arcuate end opening 30, of another pivot section 25 or 26 or spacer 27 or 28, and end spacers 31 and 32 are provided with a female arcuate end opening 33. The pivot bars 19 and 20 are, of course, for installation in the stile slots 18, as shown best in FIG. 5. The spacers 27 and 28 are provided as needed for proper spacing between the pivots 22 to accommodate a particular width of louver. For a wide louver, spacers will be needed, for a narrow louver, such spacer may not be needed. Whether or not spacers 27 and 28 are utilized, end spacers 31 and 32, respectively, are included to maintain the bar end of a proper distance from the bottom rail 12, as shown in FIG. 5 and 7. Which end spacers 31 and 32, are preferably closed across their lower end and, as set out above, are each arranged to receive the pivot section male end 29 in a female arcuate end opening 33, as shown in FIGS. 6 and 7. The end to end coupling of the retracting pivot sections 25 with spacers 27 and end spacer 32 is a flush fit to form a flat bar, as illustrated, in FIG. 8, as it should be understood, is the end to end coupling of the fixed pivot sections 26 spacers 28 and end spacers 32, as shown in FIG. 7.

As set out above, the louvers 17 are preferably arranged to pivot freely around pivots 22 of the respective retracting and fixed pivot bars 19 and 20. To synchronize such louver pivoting shutter 10 preferably employs, as shown best in FIG. 4, a straight, narrow, flat rectangular bar 34. Bar 34 is arranged to receive nails 36, or like connectors, that are fitted through holes 35 into louver 17 ends, the nails 36 driven therein essentially parallel to the louver faces. In closing the louvers, for providing a tight engagement of the one louver surface over another, the tilt rod 34, as shown best in FIG. 2, is preferably arranged to travel into and nest within a groove or stepped portion 37 of the right stile 14. Which grooved or stepped portion 37 is adjacent and at a right angle to the longitudinal slot 18 and aligns with a notch 38 that is formed laterally into each fixed pivot 22 the notch 18 to receive the tilt rod nested therein. Tilt rod 34 simultaneously moves the louvers 17 into a tight fitting overlapping engagement.

Figure 9:
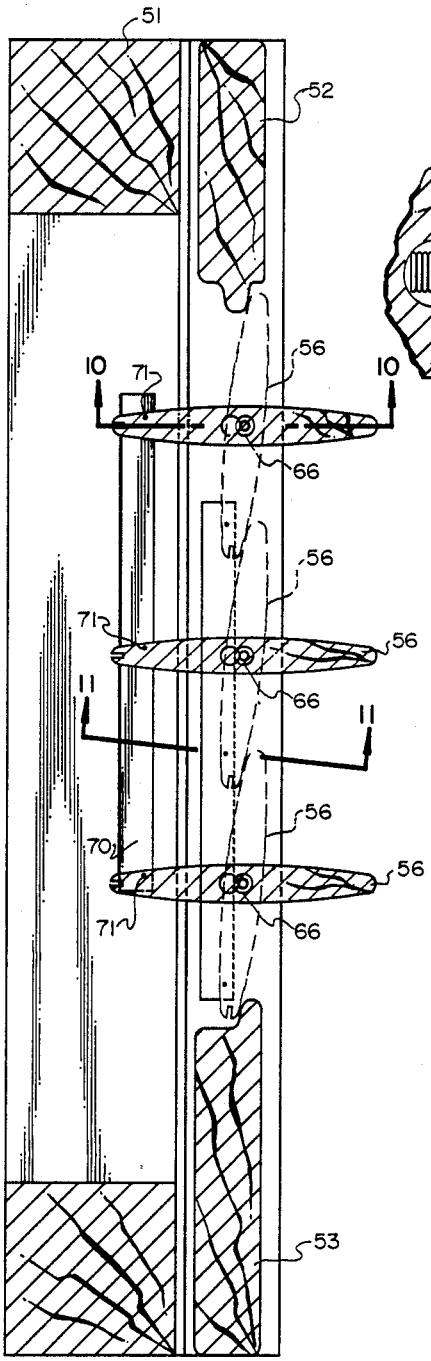
FIG. 9 shows a side elevation sectional view of another embodiment of a swivel shutter assembly of the present invention that is mounted to a window casing, with a left stile thereof having been removed.
Figure 10:
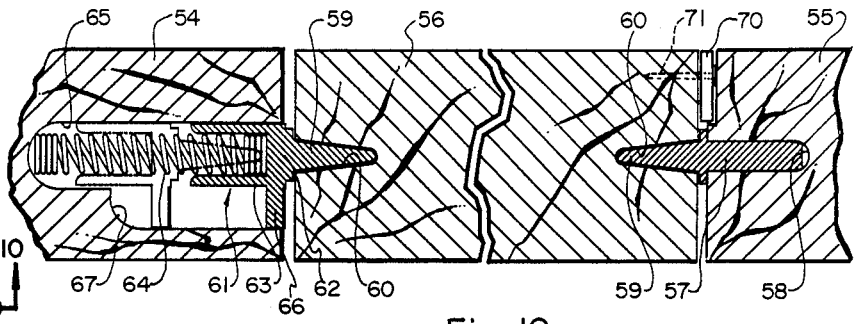
FIG. 10 shows a sectional view taken along the line 10—10 of FIG. 9, with sections of opposing left and right stiles and a louver section having been removed.

FIG. 9 shows another embodiment of a swivel shutter assembly 50, hereinafter referred to as shutter. Shutter 50 is shown in FIGS. 9 and 10 mounted by hinges, or the like, not shown, across a window casing 51. The shutter 50 includes top and bottom rails 52 and 53, respectively, and left and right stiles 54 and 55, respectively, that are assembled, as described with respect to shutter 10 into a shutter frame, with louvers 56 pivotally mounted therein. For maintaining the louver pivot mounting, shutter 50 includes, as shown in FIG. 10, fixed pivots 57 and retracting pivots 61. The fixed pivots 57 are individually set into holes 58 that are formed at spaced intervals in right stile 55. Like the earlier described pivots 22 and shutter holes 21 of FIGS. 2 and 5, pivot ends 59 of the fixed pivots and laterally centered longitudinal shutter holes 60 are tapered to have a cone shape, as shown best in FIG. 10, the pivot ends are fitted in the shutter holes 60 in self centering arrangement.

As shown in FIG. 10, the retracting pivots 61 each include a pivot 59 loosely fitted in shutter holes 60 formed in left stile 54. Which pivot 59 extends at a right angle outwardly from a base 62, the base 62 arranged to close over a top end of a cylindrical body 63. The cylindrical body 63 is open at a bottom end and contains a coil spring 64 that extends therefrom. The assembly of retracting pivot 61 and coil spring 64 is installed in loose fitting arrangements in a spring cavity 65 that is formed in left stile 54. Which spring cavity is immediately opposite to a fixed pivot hole 58 formed in right stile 55. Shown best in FIG. 10 the retracting pivot base 62 extends at a right angle from the side of the cylindrical body, forming a pivot retraction tab 66. For travel into the left stile 54, a retraction hole 67 is formed alongside and into the spring cavity 65. So arranged, the cylindrical body can be moved within the spring cavity 65 responsive to urging the pivot retracting tab 66 into the retraction hole 67. A tool, such as a screwdriver, not shown, can be used to push the pivot retracting tab 66 into the retraction hole 67. Which movement retracts the pivot 61 moving therewith into the left stile 54, as shown in broken lines in FIG. 10.

An operator depressing the pivot retracting tab 66 into the retracting hole 67 allows a louver 56 to be aligned within the shutter frame. That installation includes fitting first one louver end onto the pivot 59 of fixed pivot 57, and then rotating the other louver end such that the shutter hole 60 aligns with the end of pivot 59 of the retracting pivot 61. On release of the force depressing the retraction tab 66 the coil spring 64 urges the pivot 59 into shutter hole 60, completing the shutter pivot coupling.

With the shutter 56 pivoted to the vertical attitude shown in broken lines in FIG. 9, the pivot retracting tab 66 is available to an operator who fits the end of a screwdriver thereagainst to depress that pivot retracting tab 66 and connected cylindrical body 63. The pivot 59 is thereby retracted out from the shutter hole 60, allowing that shutter 56 to be rotated out of the shutter frame. So arranged, the individual shutters 56 can be easily installed in and removed from the shutter frame.

Figure 11:
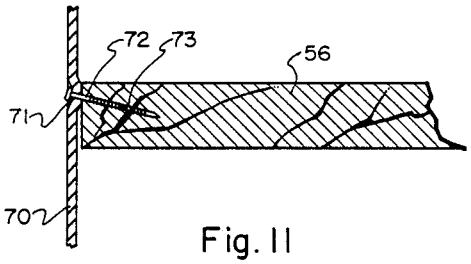
FIG. 11 shows a sectional view taken along the line 11—11 of FIG. 9, showing a nail driven on the bias through a tilt rod and into a louver end.

Shutter 50, like shutter 10, as shown in FIGS. 9 and 11, preferably includes a tilt rod 70 for simultaneously pivoting the louvers 56 within the shutter frame. Tilt rod 70, is like tilt rod 34, except that pivot holes 71 that are formed at spaced intervals therethrough are laterally off-centered. In assembling the shutter 50, the tilt rod side that is closest to the off-centered pivot holes 71 is positioned across the louver ends so as to be next to and to rest against the fixed pivots of the right stile 55. As shown in FIG. 11, the spacing distance of the tilt rod 34 to the fixed pivot 57 is further shortened b fitting a nail 72 through pivot hole 71 and driving it into a hole 73 in the louver 56 end that is formed on a bias or at a diagonal to the wood grain. Forming the hole 73 on the bias is to minimize a likelihood of splitting the louver end as could occur when the nail 72 is driven straight into the louver, that nail traveling just below a face thereof. Tilt rod 70, is pivotally coupled to louver 56 end, as set out above, so as to provide an off-set mounting whereby, when the louvers are closed, a tight overlap is provided without a necessity of notching the fixed pivot 57.

Figure 12:
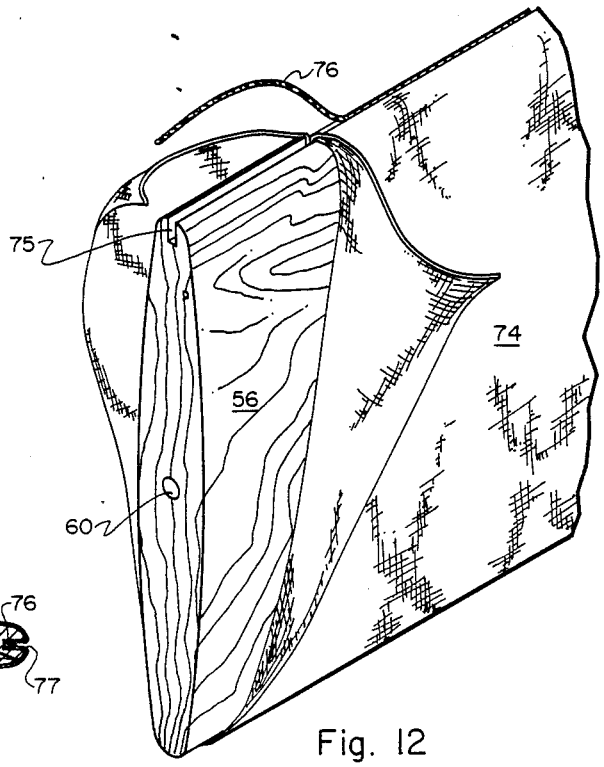
FIG. 12 shows an end perspective view of a first louver that includes a section of a flexible material wrapped and secured therearound as a decorative covering.
Figure 13:
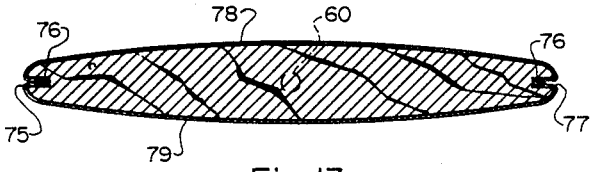
FIG. 13 an end elevation view of another louver with sections of a flexible material secured from louver edge to edge, across the louver faces.

Both the shutters 10 and 50 are intended to provide a decorative and attractive shutter that is easily and quickly assembled. As a further decorative feature the present invention provides, as shown in FIGS. 12 and 13, for covering the opposite shutter 56 face with a section 74, or sections 78 and 79, of a flexible covering material, such as a fabric. Shown in FIG. 12, to provide for attaching a section of such fabric material, as a veneer to the shutter, a longitudinal groove or slot 75 is formed along a louver edge. The section of material is then wrapped around the louver, with the opposite edges of that material fitted into the groove or slot. A string 76, or a like wedging device is then fitted and pressed into the groove or slot, between the section of material edges, such string 76 can be forced therein as by running a blunt knife blade edge therealong. The string 76 is thereby urged into the slot so as to bind or wedge it against the section of material edges, locking them in the groove.

FIG. 13 shows another embodiment of louver 56 for mounting, over opposite louver faces, individual sections of material 78 and 79. To provide this mounting the opposite louver edges are grooved or slotted longitudinally at 75 and 77. The grooves or slots to receive edges of the respective sections of material fitted therein, with strings 76, or the like fitted in and forced tightly therein, as by running a blunt edge blade in each groove so as to bind the material edges therein.

While preferred embodiments of the present invention have been shown and described herein, it should be understood that the present disclosure is made by way of example only and that variations to the invention are possible within the scope of this disclosure without departing from the subject matter coming with the scope of the following claims and a reasonable equivalency thereof, which claims I regard as my invention

I claim:

1. A swivel shutter assembly comprising, a shutter frame formed from left and right stiles top and bottom rails, which stiles are secured at their ends to ends of said top and bottom rails, forming a rectangular frame;

fixed pivot means consisting of individual pivots that project inwardly into said rectangular frame at spaced intervals from one stile side;

retracting pivot means consisting of individual pivots that project inwardly at spaced intervals from the opposite stile side, said retracting pivot means aligning with said pivots of said fixed pivot means, and are capable of being individually retracted to below the level of said stile side; and a plurality of louvers, each louver holed at its opposite ends for fitting, respectively, into the aligned pivots of said fixed and retracting pivot means.

2. A swivel shutter assembly as recited in claim 1, wherein the top and bottom rail ends are dovetailed to slide into longitudinal dovetailed slots formed in each stile.

3. A swivel shutter as recited in claim 1, wherein the left and right stiles are longitudinally slotted along their opposing sides; and the fixed and retracting pivot means are arranged in sections for coupling in end to end relationship into bars that are for fitting into longitudinal slots formed in each of the stile opposing sides.

4. A swivel shutter assembly as recited in claim 3, the fixed and retracting pivot means sections include, as coupling means, round male and arcuate female segments that are arranged on opposite section ends, said round male segment for fitting, in locking engagement, into said arcuate female segment when laid thereover and the segments pressed together.

5. A swivel shutter assembly as recited in claim 3, further including spacer means for arrangement between the fixed and retracting pivot means sections for increasing the distance between the individual pivots; and end spacer means for coupling to at least one end of the fixed and retracting pivot means sections that are joined into bars.

6. A swivel shutter assembly as recited in claim 3, wherein the retracting pivot means sections, each include a base member that is arranged between the end coupling means and whereto an end of a flexing arm is connected with said flexing arm connection to said base member formed of a material to function as a resilient hinge means whereby said flexing arm is biased away from said base member, and the flexing arm end opposite to said hinge means includes a pivot that extends outwardly therefrom.

7. A swivel shutter assembly as recited in claim 6, further including spring means included with the flexing arm for providing additional biasing to said flexing arm.

8. A swivel shutter assembly as recited in claim 7, wherein

The spring means is a flat, thin narrow bar formed from a resilient material that is for installation through the resilient hinge means and along into the flexing arm.

9. A swivel shutter assembly as recited in claim 8, wherein the spring means is a section of spring steel.

10. A swivel shutter assembly as recited in claim 3, wherein the fixed and retracting pivot sections are formed from a resilient plastic material.

11. A swivel shutter assembly as recited in claim 1, wherein

The left and right stiles opposing sides are holed at spaced intervals therealong for a desired width of louver, said holes for receiving individual fixed and retracting pivot means fitted therein, the pivots of pairs of which fixed and retracting pivot means to align with one another;

the fixed pivot means are individual pivots each having a base for fitting into one of said holes formed in a stile side, said fixed pivot to extend axially therefrom;

the retracting pivot means are individual assemblies of a cylindrical body, that is closed across one end by a plate that extends outwardly from a side of said cylindrical body, forming a retracting tab, which plate includes a pivot projecting at a right angle therefrom; and spring biasing means arranged within said cylindrical body to bias outwardly from its seat on one of said holes formed in one said stile side.

12. A swivel shutter assembly as recited in claim 11, wherein each retracting pivot means retracting tab is arcuate around its outer circumference;

the individual holes formed in the stile side to receive each said retracting pivot means are side by side overlapping cylindrical holes, one hole for accommodating the cylindrical body in loose fitting arrangement therein and the other to accommodate travel therein of said retracting tab; and the spring biasing means are individual coil spring means, each for fitting within said cylindrical body, extending therefrom into one said cylindrical hole.

13. A swivel shutter assembly as recited in claim 1, wherein the pivots of the fixed and retracting pivot means are conical in shape as are the holes that are formed in the louver ends.

14. A swivel shutter assembly as recited in claim 1, further including, a tilt rod means for pivotal coupling to aligned ends of the louvers, said tilt rod means for manual movement to simultaneously pivot the louvers; and means for pivotally mounting said tilt rod means to each said louver end.

15. A swivel shutter assembly as recited in claim 14, wherein the stile side that is adjacent to the tilt rod means is grooved longitudinally to accommodate the tilt rod means nesting therein.

16. A swivel shutter assembly as recited in claim 15, wherein the pivots of the fixed pivot means that are fitted in the one stile side in spaced apart holes are laterally notched so as to accommodate said tilt rod means nesting thereagainst.

17. A swivel shutter assembly as recited in claim 15, wherein the tilt rod means is a thin, straight, bar section that is holed at spaced intervals for receiving the means for pivotally mounting said tilt rod means to each said louver end.

18. A swivel shutter assembly as recited in claim 17, wherein the tilt rod means holes are off-set laterally to one side of said bar; and the means for pivotally mounting are nails that are each driven through one of said holes on the bias into the louver ends, each nail to travel across the louver grain.

19. A swivel shutter assembly as recited in claim 1, further including a section of flexible material that is cut for covering the louver faces;

at least one longitudinal slot formed in a louver longitudinal edge for receiving opposite edges of said section of flexible material; and means for fitting, end to end, in said louver edge longitudinal slot, wedging against said edges of said section of material.

20. A swivel shutter assembly as recited in claim 19, wherein longitudinal slots are formed in both louver edges;

separate sections of material are fitted over the louver faces, with their opposite edges fitted into said longitudinal slots; and string means that are installed in each said longitudinal slot so as to wedge against said edges of said sections of flexible material.

21. A swivel shutter assembly as recited in claim 19, wherein the section of material is a piece of cloth having a decorative surface appearance.

* * * * *